US006054660A

United States Patent [19]

Benni

[11] Patent Number: 6,054,660

[45] **Date of Patent: *Apr. 25, 2000**

[54] CONTROL OR SIGNALING DEVICE SUCH AS A PUSH-BUTTON

[75] Inventor: Dominique Benni, Mornac, France

[73] Assignee: Schneider Electric SA, Boulogne Billancourt, France

[ * ] Notice: This patent is subject to a terminal disclaimer.

[21] Appl. No.: 09/117,185

[22] PCT Filed: Jan. 29, 1997

[86] PCT No.: PCT/FR97/00171

§ 371 Date: Aug. 17, 1998

§ 102(e) Date: Aug. 17, 1998

[87] PCT Pub. No.: WO97/28552

PCT Pub. Date: Aug. 7, 1997

[30] Foreign Application Priority Data

Jan. 29, 1996 [FR] France ..... 96 01463

[51] Int. Cl.[7] ..... H01H 9/08

[52] U.S. Cl. ..... 200/307; 200/296

[58] Field of Search ..... 200/307, 294, 200/295, 296; 361/636; 439/532

[56] References Cited

U.S. PATENT DOCUMENTS

| | | | |
|---|---|---|---|
| 3,568,795 | 3/1971 | Mentel et al. | 200/307 X |
| 3,676,630 | 7/1972 | Dennison | 200/295 |
| 4,250,368 | 2/1981 | Johnsston et al. | 200/307 |
| 4,587,391 | 5/1986 | Harper | 200/296 |
| 5,768,091 | 6/1998 | Vinson et al. | 200/294 X |
| 5,800,206 | 9/1998 | Benni . | |

FOREIGN PATENT DOCUMENTS

| | | | |
|---|---|---|---|
| 1232631 | 1/1967 | Germany | 200/294 |

*Primary Examiner*—Renee S. Luebke
*Attorney, Agent, or Firm*—Oblon, Spivak, McClelland, Maier & Neustadt, P.C.

[57] ABSTRACT

A control or signaling device such as a push-button or an indicator lamp including one or more electrical units attached to a base is disclosed. The electrical unit (30) and the base (20) include a rigid projection (40) and a hook (50), e.g. a U-shaped hook, and a retaining shoulder (23) and a recess (25) coacting therewith, respectively. The hook is preferably resiliently biased in a direction parallel to the mutual engagement surfaces (32, 27) of the unit and the base, and extends in the same direction as the projection.

11 Claims, 3 Drawing Sheets

28b
28a
30
F
20
23
28a
24
40
37a
36a
21
32
38
33
70
34a
29a
38
III
29
27
27a
38a
50
73
Y
III
37b
71
38a
39a 56
50a
55
52
54
50
51
57
54a
53
63
37b
62
60
31a
61
63
39
32
31b
62

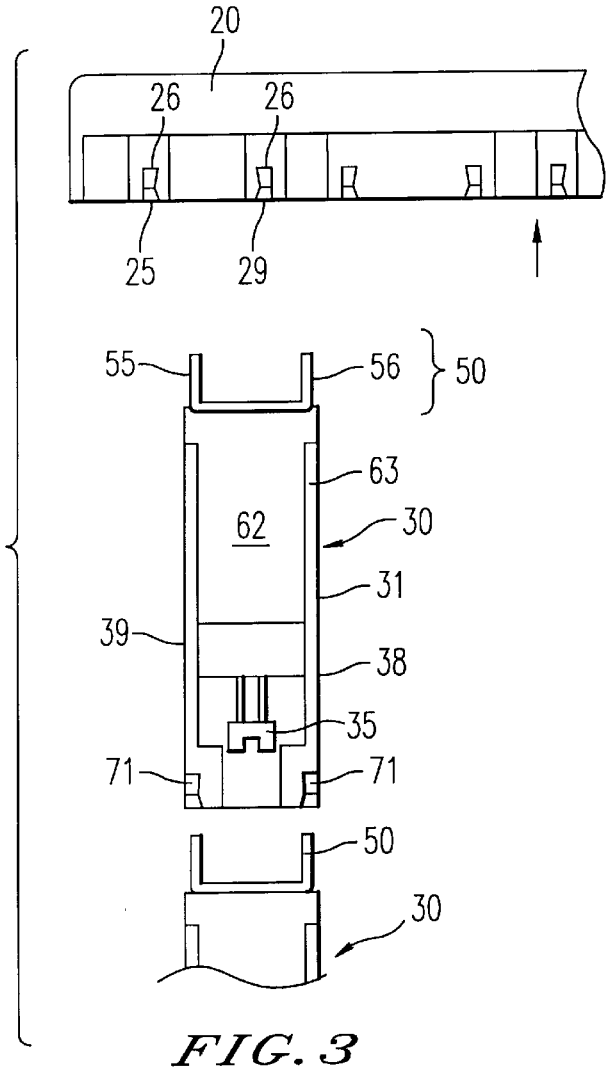
FIG. 3
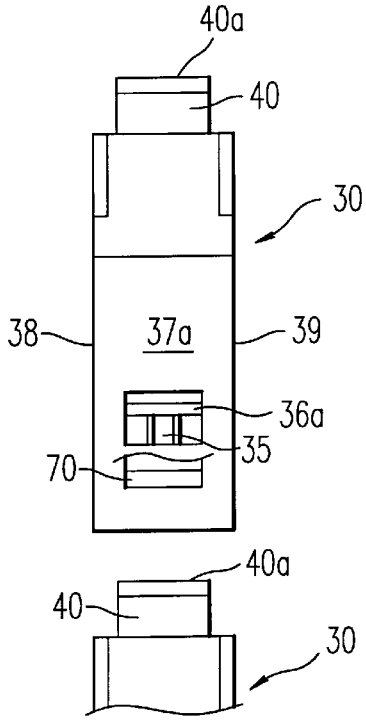
FIG. 4
FIG. 6
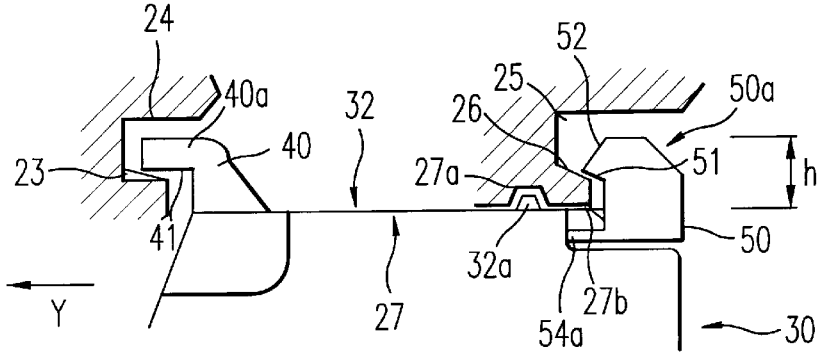

CONTROL OR SIGNALING DEVICE SUCH AS A PUSH-BUTTON

This invention relates to a control or signaling device such as a push button assembly.

This type of device comprises firstly a body that fits into an orifice in a support wall, for example a panel or desk, and secondly a socket in which an electrical block is placed removably, particularly a contact block, using assembly means associated with corresponding assembly faces and frequently composed of click fit elements.

Known devices of this type do not always have the required assembly stiffness, and it will be desirable to improve them so that a fitter can easily engage and fix the contact block under the socket; similarly, it will be desirable for him to be able to easily stack another contact block with satisfactory stiffness under the previous block.

The purpose of the invention is to make it easy for the fitter to assemble a contact block under a socket on an electrical control or signaling device, and for the assembly thus obtained to be sufficiently stiff.

According to the invention:

the electrical block and the socket comprise a rigid tenon at one end of their corresponding assembly faces, and a complementary shaped retaining shoulder that work together to position and hold the block in place, at the end opposite the assembly face to the socket, the block comprises a hook acted upon by elastic means parallel to the assembly face cooperating with a latched housing formed in the socket.

The hook may advantageously be composed of a U-shaped metal part, the ribs of which are approximately aligned with the main side walls of the electrical block. Furthermore, it may be useful to orient the rigid tenon and the hook in the same direction, which reduces the size of the block and makes the installation more intuitive, while the elements with cooperating shapes may beneficially be provided on assembly faces in order to prevent the block from sliding with respect to the socket when a force is exerted on the electrical block perpendicular to the device support wall.

The following description of an embodiment of the invention relates to the attached drawings and explains the advantages and results of the invention.

FIG. 3 is a partial exploded sectional view of the stack in FIG. 2 along plane III—III.

FIG. 4 is a partial exploded view of the stack in FIG. 2 along direction F.

FIG. 6 shows a detail of FIG. 1 at larger scale.

The electrical control or signaling device illustrated on the figures is a push button comprising a body 10 fitted with a head 11 and a tubular part 12 with center line X1 and diameter smaller than the head width. This part may be installed with a seal and/or label (not shown) on an external face 13*a* of a thin support wall 13, for example a metallic wall, which belongs to an enclosure such as a desk, cabinet, etc. The wall 13 is oriented along a plane S perpendicular to X1 and comprises an orifice 13*b* in which the tubular part 12 of the push button fits with a certain clearance, this part for example including the mobile part of the button push rod.

Figure 1:
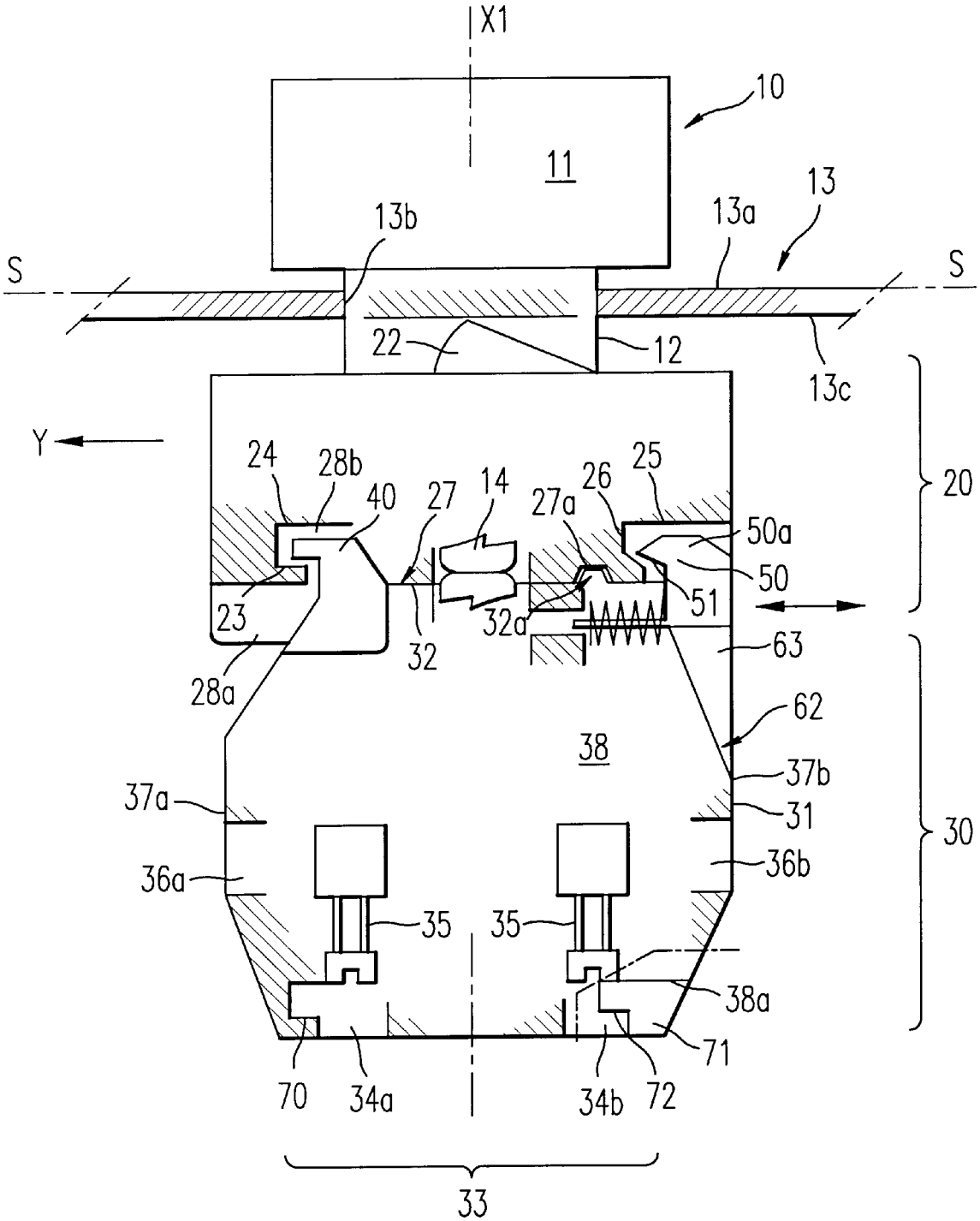
FIG. 1 is a sectional elevation of a push button assembly according to the invention.
Figure 2:
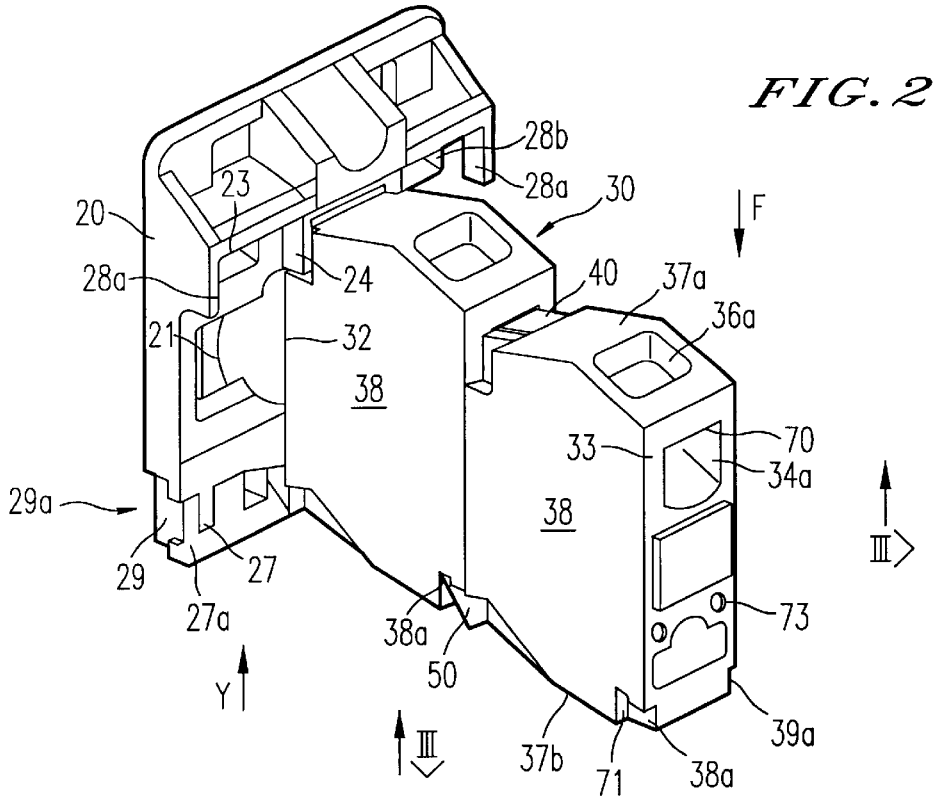
FIG. 2 is a perspective bottom view of a stack of two contact blocks assembled with a socket in an assembly according to FIG. 1.

A socket 20, in general with a polygonal shape but preferably rectangular, is associated with the push button on the back of the wall 13, in other words on the side of the internal face 13*c* of wall 13, in order to removably support the detachable electrical blocks 30, such as switch contact blocks, indicating light blocks or auxiliary blocks. The socket is placed on the tubular part 12 and is attached to it by shaped elements that fit together for example by interlocking or click fitting, to prevent the socket from being extracted along direction X1. The socket 20 has a central opening 21 (see FIG. 2) to enable free passage of the tubular part 12 of the push button, and it is also held in place in contact with the internal face 13*c* of wall 13 by means of a latching slide 22 acted upon by a control screw (not shown). An element 14 of the push button, moving along direction X1, cooperates with an actuating pin specific to the electrical block.

The contact block 30 comprises a prismatic housing 31 made of an insulating material with a face 32 that assembles to the socket, on the side facing the socket, from which an actuating pin 32*a* projects; on the opposite side, the housing has a connection face 33 for the access of a tool through orifices 34*a*, 34*b* formed in this face 33, to screws or other connection elements 35 for wiring conductors. The conductors may be inserted in the side through orifices 36*a*, 36*b* formed in the small side faces 37*a*, 37*b* of the housing; finally it has large plane side faces 38, 39.

The socket 20 is made of metal or plastic; it is designed to contain several contact blocks 30 (three or more) fitted side by side with their large side faces adjacent. Each contact block 30 has a rigid tenon 40 and a hook 50 that is free to move along the Y direction at both ends (in other words on its small sides) of its assembly face 32 that is elongated and approximately rectangular. The socket 20 comprises guide side plates 28*a* that cooperate with the large side faces 38, 39 of block 30 to facilitate the tenon fitting into an opening 24 in the socket and the guide walls 28*b* delimiting the sides of the opening and cooperating with the side faces of the tenon.

The rigid tenon 40 has a free end 40*a* that extends away from hook 50 and it is oriented along a direction Y that is parallel to the S plane and to the large sides of the housing; the tenon 40 comprises a contact area 41 approximately parallel to S and working in conjunction with a corresponding retaining shoulder 23 formed with a shape complementary to the shape of the tenon in the socket opening 24.

The mobile hook 50 is oriented along the same direction Y and in the same sense, to cooperate with a latching housing 25 provided in the socket 20. For this purpose, it comprises an oblique edge 51 at its free end 50*a* that works in cooperation with an inclined face 26 of the housing 25. The inclination of the edge 51 and face 26 enables compensation for play; it is also designed such that the proportion of the forces transferred by the push button to the contact block 30, resisted by the hook 50, tends to push it towards the right. Therefore, to prevent the contact block from being extracted outside the socket by sliding when pressure is exerted on the push button, block 30 has a projection from its assembly face 32 consisting of at least one pin 32*a*, for example there may be two such pins, that fit into at least one recess 27*a* provided in a coupling face 27 of the socket; obviously, it would be possible to use elements with a similar shape instead of elements 27*a*, 32*a*, laid out to prevent the block from coming out of the socket under the effect of sliding along the Y direction. Furthermore, the hook 50 comprises an oblique area 52 that works in cooperation with an edge 27*b* of the coupling face 27. When the hook is moved upwardly, the oblique area 52 strikes edge 27*b* forcing the hook to the right and compressing helical spring 53. When edge 51 reaches face 26, the hook moves to the left releasing the compressed spring. Note that the tenon 40 and the hook 50 project by a comparable height h above the assembly face 32.

Figure 5:
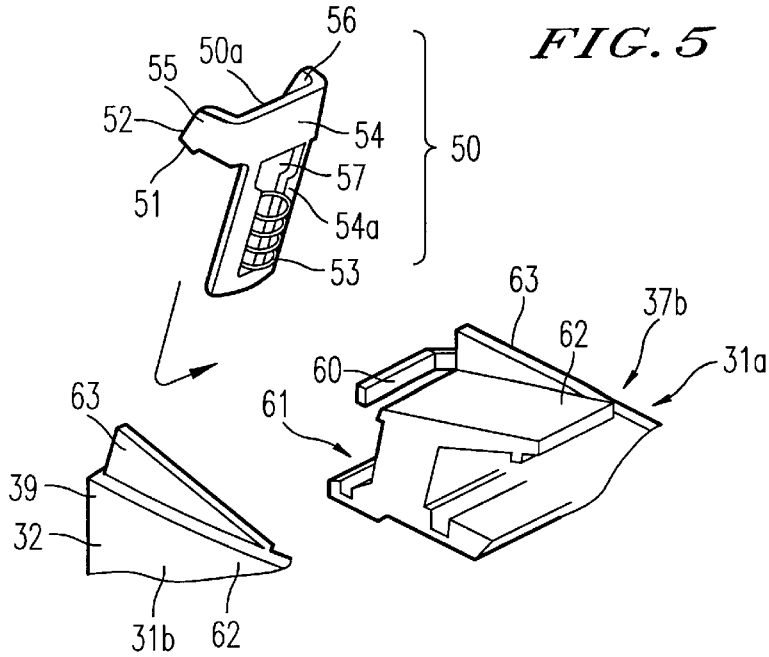
FIG. 5 shows a perspective exploded view of a detail of the contact block.

The hook 50 (see FIG. 5) is in the form of a U-shaped metal part with a flat web 54, and the flanges 55, 56 of which form the latching elements with oblique edges 51 and inclined faces 52. Note that the flanges 55 and 56 are advantageously parallel to or approximately parallel to the large side faces 38, 39 of the block and work in cooperation with the guide walls 29 provided in the side recesses 29*a* in the socket. The web 54 is elongated towards the inside of the block through a flat guide rod 54*a* that slides inside a slit 60 provided facing the assembly face 32 of the housing 31 and which keeps the return spring 53 in position laterally. The housing preferably consists of a housing body 31*a* and a cover 31*b*; the slit 60 is formed in the housing body 31*a*. It is open laterally (perpendicular to the Y direction) at 61 and may be closed by assembling the housing cover 31*b* on the body 31*a*.

The small side face 37*b* of the housing located on the side of the hook 50 comprises an oblique facet 62 located between two elements of the wall 63 in order to provide an inclined passage to a tool controlling the hook 50; the tip of the tool is guided by wall elements 63 and cooperates with an opening 57 in the hook web 54.

On its connection face 33, the housing for the contact block 30 has coupling means with a subjacent block. These means comprise firstly a flat shoulder 70 similar to the shoulder 23 on opening 24 in the socket, and secondly a latching housing 71 with an inclined face 72 similar to the inclined face 26 of the socket housing 25. Note that the retaining shoulder 70 and the inclined face 72 are formed in the orifice 34*a* providing access to a connection screw 35 and in recesses 38*a*, 39*a* provided in the large side faces 38, 39 of housing 31. At least one orifice 73 is provided into which the pins 32*a* of the subjacent block fit. In this way, contact blocks may be stacked very easily, which nevertheless provides sufficient assembly stiffness while remaining within the overall width of the blocks.

Note that the free end 40*a* of the rigid tenon 40 is opposite to hook 50; it could also be placed such that its free end faces the hook 50. However, the solution described has the advantage that it is smaller and enables more intuitive positioning of the contact block in the socket.

I claim:

1. An electrical switching device comprising:

a body which fits into an orifice in a wall;

a socket assembled to said body on one side of said wall;

at least one electrical block containing electrical contacts, said at least one electrical block being removably directly supported by said socket;

said body and said at least one electrical block containing movable elements which move along a common thrust direction;

each of said electrical blocks having a rigid tenon on one side of an assembly face which is in contact with said socket, said socket having a fixed retaining shoulder with a shape complementary to said tenon for receiving it therein and for holding said electrical block in position;

said electrical block further having a hook on an opposite side of said assembly face, said hook cooperating with a fixed latching housing in said socket, said hook being retained in position by an elastic means in said electrical block.

2. A device according to claim 1, wherein said hook is metallic.

3. The device according to claim 1, wherein said socket includes guide side plates which cooperate with side faces of said electrical block and also includes guide walls which cooperate with side faces of said rigid tenon.

4. The device according to claim 1, said electrical block further comprising a connection face opposite to said assembly face which provides access to connection elements, said connection face including at least one latching housing and a retaining shoulder for receiving a hook and a rigid tenon, respectively, of an additional block mounted thereon.

5. The device according to claim 4, wherein said shoulder on said connection face is formed in an orifice which provides access to at least one of said connection elements.

6. The device according to claim 1, wherein a free end of said rigid tenon and a free end of said mobile hook are provided on said assembly face and are oriented in a same direction parallel to said assembly face.

7. A device according to claim 6, wherein said electrical block and said socket have corresponding elements at said assembly face which are complementary shaped to prevent said block from sliding in a direction parallel to said assembly face.

8. The device according to claim 6, wherein said electrical block is mounted on said socket by a rotational motion.

9. The device according to claim 1, wherein said hook is U-shaped with two attachment flanges extending substantially parallel to side faces of said electrical block.

10. The device according to claim 9, wherein said flanges cooperate with guide walls of said socket to help hold the block in position.

11. The device according to claim 9, wherein said hook moves parallel to said assembly face and has a web extending toward an inside of the block by a flat guide rod cooperating with a slit in said block, said elastic means also being held in position thereby.

* * * * *

UNITED STATES PATENT AND TRADEMARK OFFICE

CERTIFICATE OF CORRECTION

PATENT NO. : 6,054,660

DATED : April 25, 2000

INVENTOR(S) : Dominique BENNI

It is certified that error appears in the above-identified patent and that said Letters Patent is hereby corrected as shown below:

On the Title page, Item [ 30 ], the Foreign Application Priority Data is listed incorrectly.

Item [ 30 ] should read as follows:

--- [ 30 ] Foreign Application Priority Data

Feb. 2, 1996 [FR] France ..... 96 01463 ---

Signed and Sealed this

Twenty-second Day of May, 2001

*Attest:*

Nicholas P. Godici

NICHOLAS P. GODICI

*Attesting Officer*

*Acting Director of the United States Patent and Trademark Office*